United States Patent [19]

Shwu-Fen

[11] Patent Number: 5,050,641

[45] Date of Patent: Sep. 24, 1991

[54] PHOTOELECTRIC SINGLE HANDLE FAUCET

[76] Inventor: Sheu Shwu-Fen, 9F, No. 572, Min Chuan East Road, Taipei, Taiwan

[21] Appl. No.: 520,790

[22] Filed: May 8, 1990

[51] Int. Cl.[5] ..... F16K 11/07; F16K 31/40

[52] U.S. Cl. ..... 137/607; 251/129.04

[58] Field of Search ..... 137/625.4, 607, 625.41; 251/30.03, 129.04

[56] References Cited

U.S. PATENT DOCUMENTS

| | | | |
|---|---|---|---|
| 2,507,954 | 5/1950 | Binnall et al. | 251/30.03 X |
| 3,297,051 | 1/1967 | Church et al. | 137/624.4 X |
| 3,916,950 | 11/1975 | Mongerson et al. | 137/625.41 |
| 4,033,373 | 7/1977 | Manoogian et al. | 137/625.4 X |
| 4,535,821 | 8/1985 | Anderson | 137/625.4 X |
| 4,681,141 | 7/1987 | Wang | 137/607 |
| 4,741,363 | 5/1988 | Hu | 137/607 |
| 4,860,990 | 8/1989 | Fukuzawa et al. | 251/30.03 |

*Primary Examiner*—Stephen M. Hepperle
*Attorney, Agent, or Firm*—Dvorak and Traub

[57] ABSTRACT

A type of multi-purpose photoelectronic automatic sensing faucet mechanism with single handle and water temperature regulation and water stop functions, an interior mechanism in faucets to be used in basin, shower tap and kitchen, comprising mainly of a piston rod fixing seat, a constant pressure water stop plate, a water output control valve, a temperature regulating and water stop turning shaft, a temperature regulating and water stop turning shaft fixing seat and a water inlet hole overflow check pad. Its water output is controlled by infra-red ray photoelectronic sensing switch solenoid, producing imbalance of water pressure in the solenoid, causing automatic control of water output, and coordinated with the design of single-handle temperature control and water stop function manual switch, to suit different user's requirement of temperature and convenient operation.

2 Claims, 8 Drawing Sheets

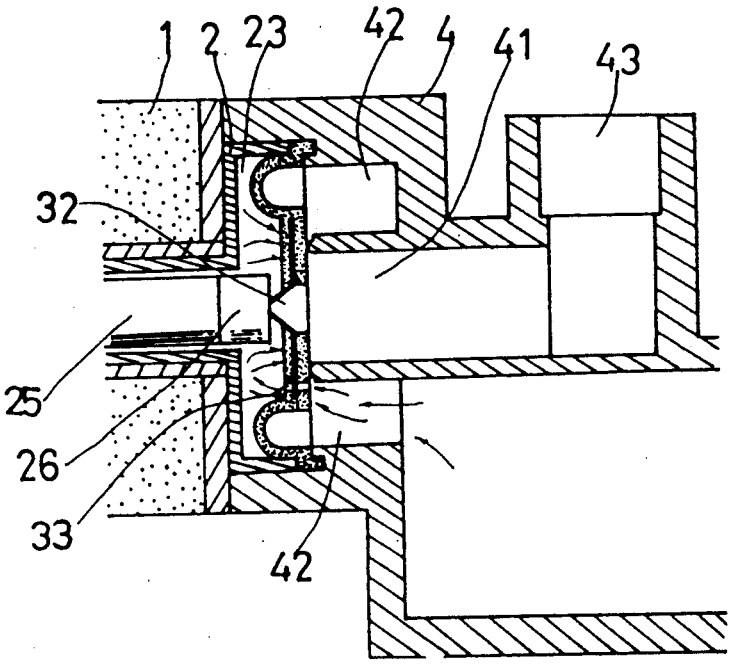
FIG. 3-A
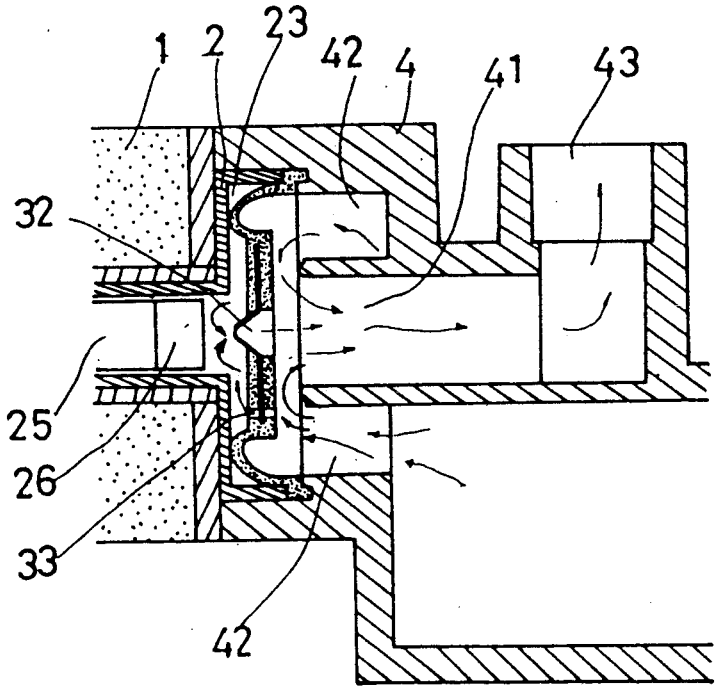
FIG. 3-B

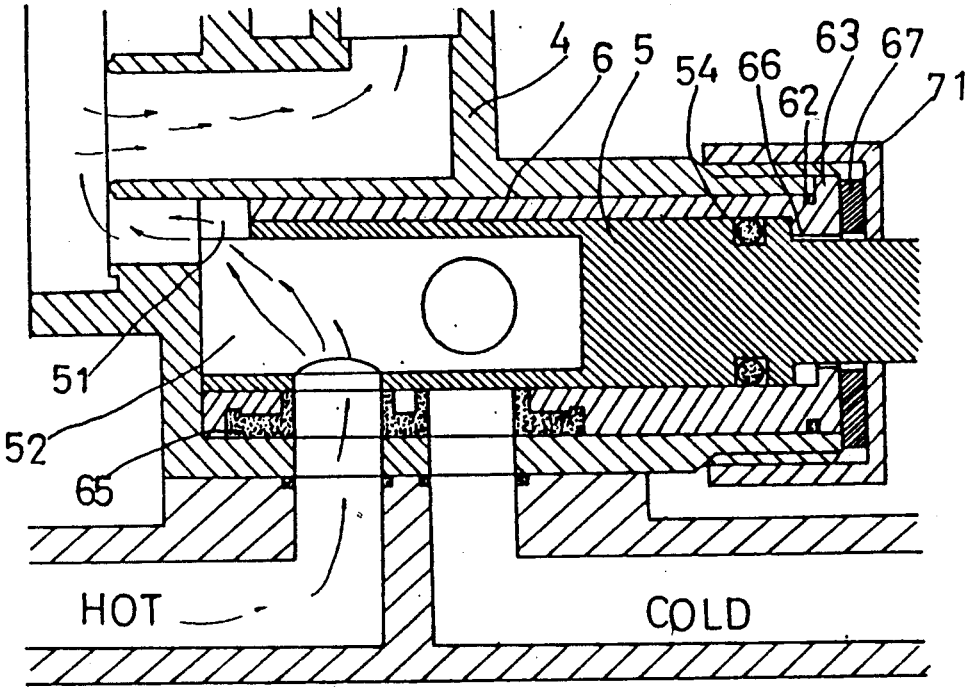
FIG.4-A
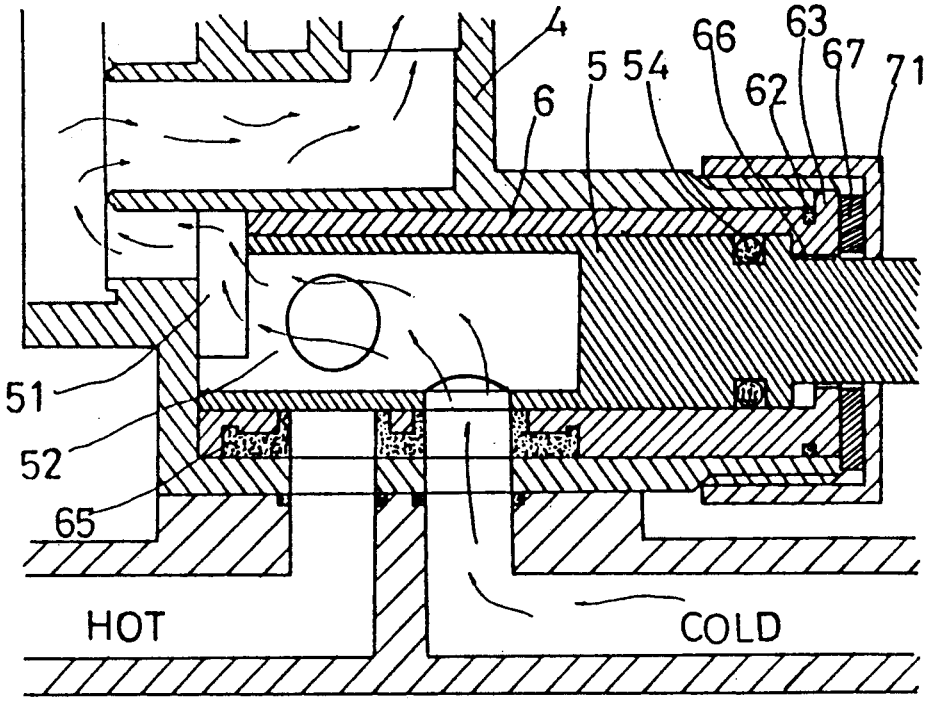
FIG.4-B

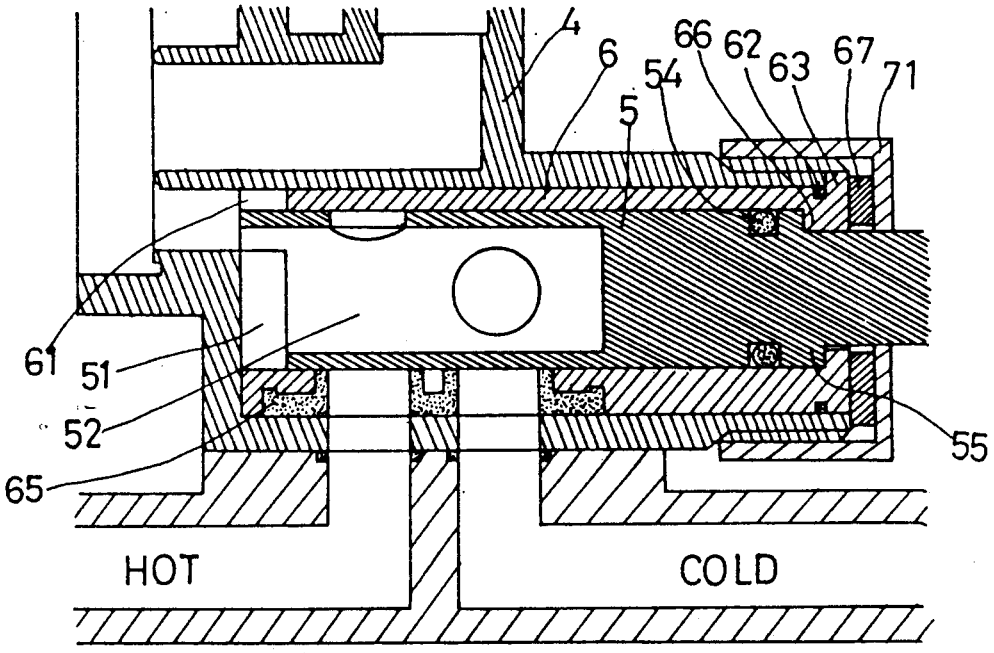
FIG 4-C

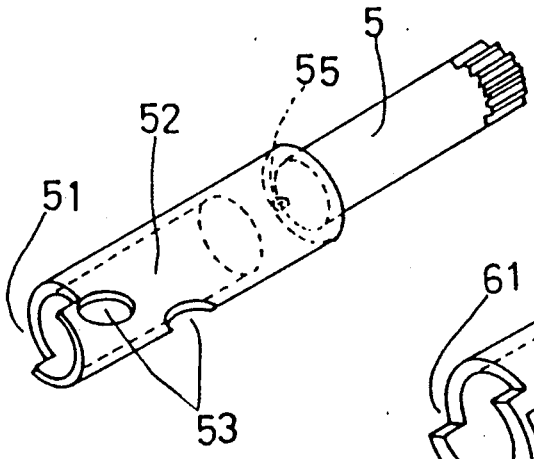
FIG.5-A
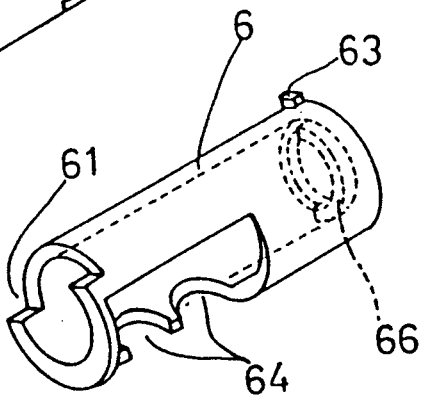
FIG.5-B

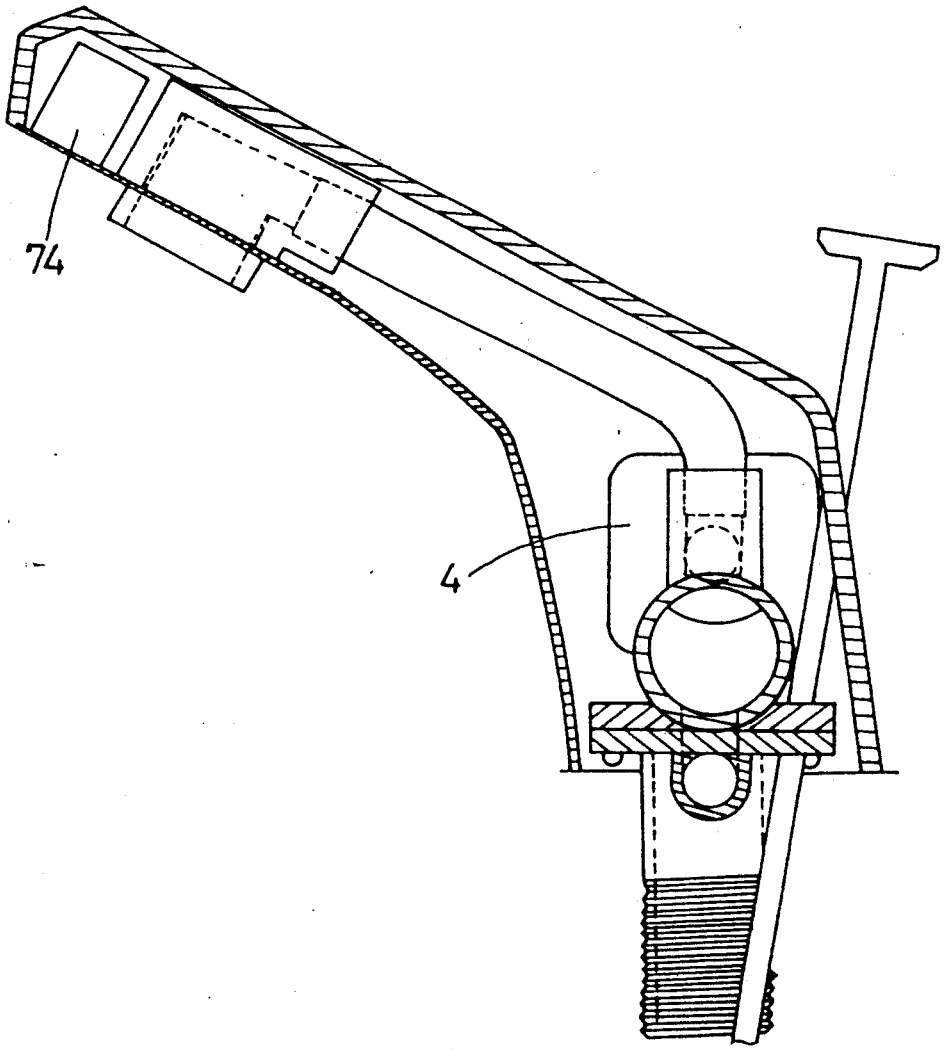
FIG. 6-A

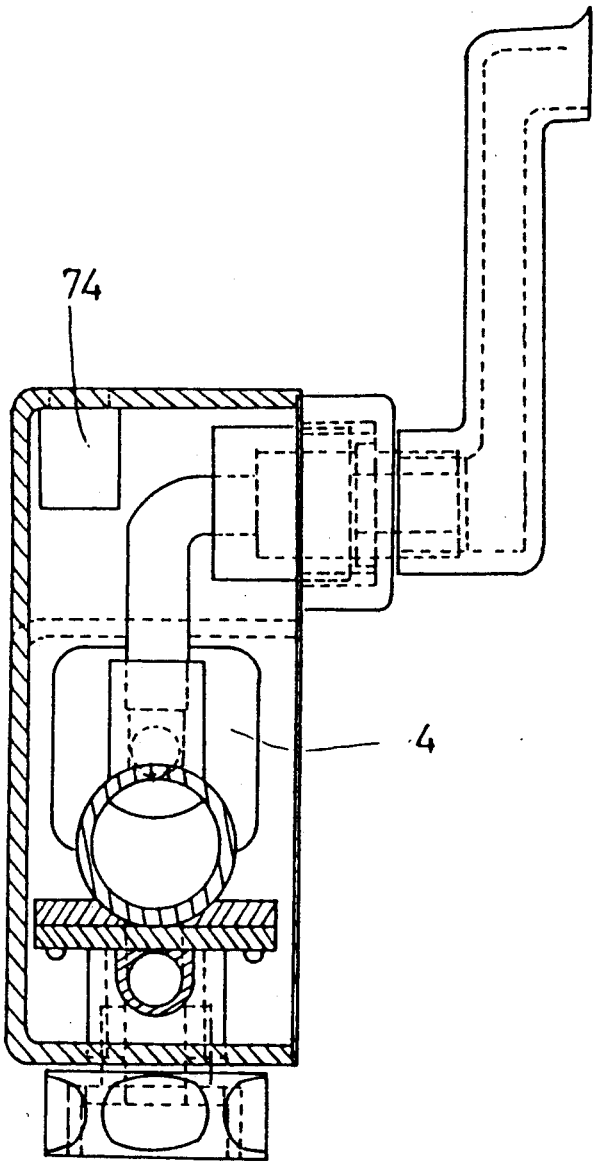
FIG.6-B

PHOTOELECTRIC SINGLE HANDLE FAUCET

BACKGROUND OF THE INVENTION

With rapid development of social economics and advanced development of scientific technology, people's demand for improved products has increased. As a result, automated products have gradually appeared to satisfy people's requirements.

Due to the rampage of infectious diseases, people want sanitary articles at public places. As a result, automated sensing facilities are widely employed at public places. The subject invention is an apparatus which satisfies the requirements of convenient household use and sanitary considerations at public places.

Due to worldwide lack of water resources, insufficient development of water resources to meet the demand, insufficient education on conserving water consumption, etc., the ways to control water channels or improve water consumption habits have become more and more important. Because conventional water taps are not easily opened or closed, the users would often forget to tighten the faucet and cause water discharge waste. Some would even tighten the faucet too much for fear of water leakage, and cause quick wear and tear on water-stoppage parts, which results in water leakage. This invention has been developed to solve the above problems.

On the market there are several automatic sensing faucets being sold, but they do not satisfy the requirements of light weight, compactness and easy operation. Public places usually utilize only single-use cold-water faucets that are large in size, and are difficult to fit, or cold-and-hot-water combination faucets having plastic structure that cannot resist heat, or faucets having a cold and hot water mixing function but are of poor design with respect to the mixing mechanism, resulting in poor cold and hot regulation effects, which may even result in a burn to the user because of heat expansion and jammed mechanisms. Aimed at those problems, this invention has been researched and developed to improve and overcome them, and to coordinate with human use.

Another feature of the invention is the cold/hot combination handle with a water stoppage function, so that there will be no trouble of automatic water discharge when the user is in contact with the light sensing switch, and to achieve the purpose of conserving water. As for a continued water discharge function, electronic control may be adopted.

SUMMARY OF THE INVENTION

This invention relates to an interior mechanism for a faucet suitable for basin, bath tub, and kitchen purposes, featuring a solenoid switch to produce imbalance of water pressure inside the solenoid, to produce the effect of automatic control of water output. For a user's convenience, and for reducing water consumption, an infrared ray photoelectric sensing switch control is used to achieve the purpose of automation. Because each user's sensitivity to temperature is different, the single handle control is designed to include a water stoppage function, to suit different users' requirements, and for convenient operation. Furthermore, the various components of the invention are independently assembled to achieve the purpose of easy maintenance and replacement of components, and the user can perform the installation and repairs, to save increasing installation and repair expenses.

BRIEF DESCRIPTION OF THE DRAWINGS

FIG. 3A is a section view of the solenoid.

FIG. 3B is a section view of the solenoid.

FIG. 4A is a section view of the mixing chamber.

FIG. 4B is a section view of the mixing chamber.

FIG. 4C is a section view of the mixing chamber.

FIG. 5A is a perspective view of the temperature regulating and water stopping shaft.

FIG. 5B is a perspective view of the temperature regulating and water stopping shaft fixing seat.

FIG. 6A is a section view of the subject invention.

FIG. 6B is a section view of the subject invention.

DETAILED DESCRIPTION OF THE PREFERRED EMBODIMENTS

Figures 1A, 1B:
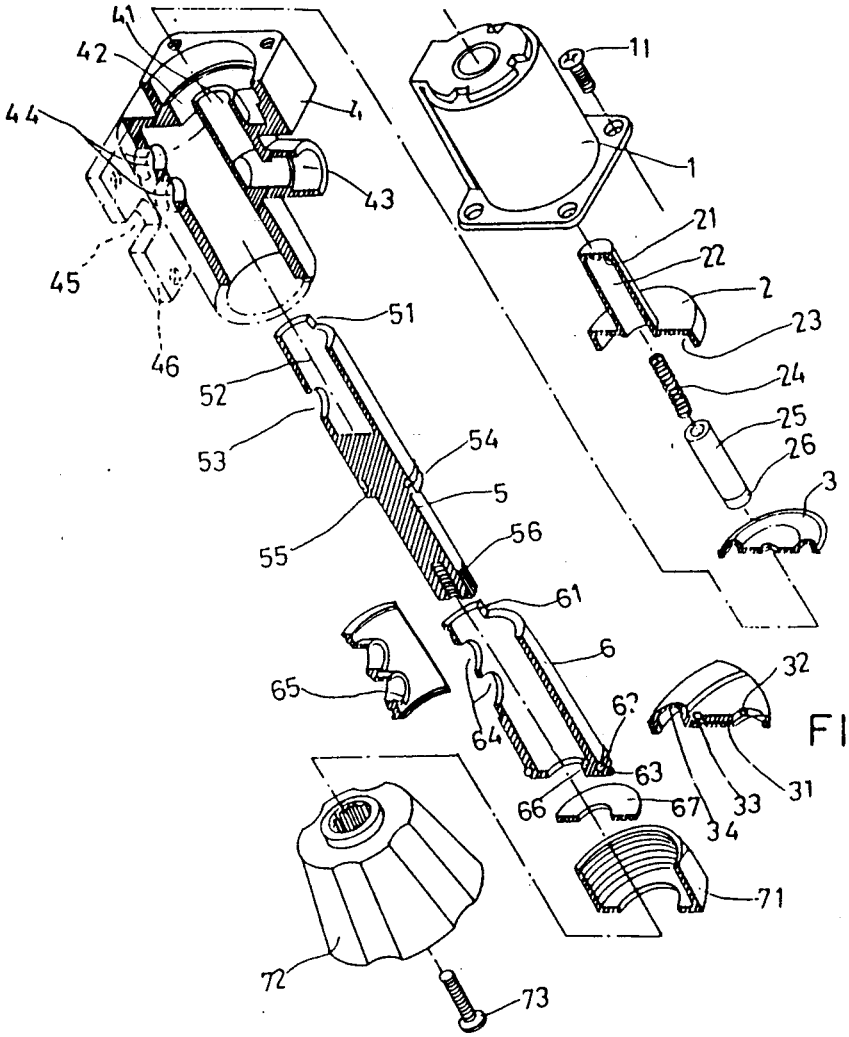
FIG. 1 is an exploded view of the subject invention.
Figure 2:
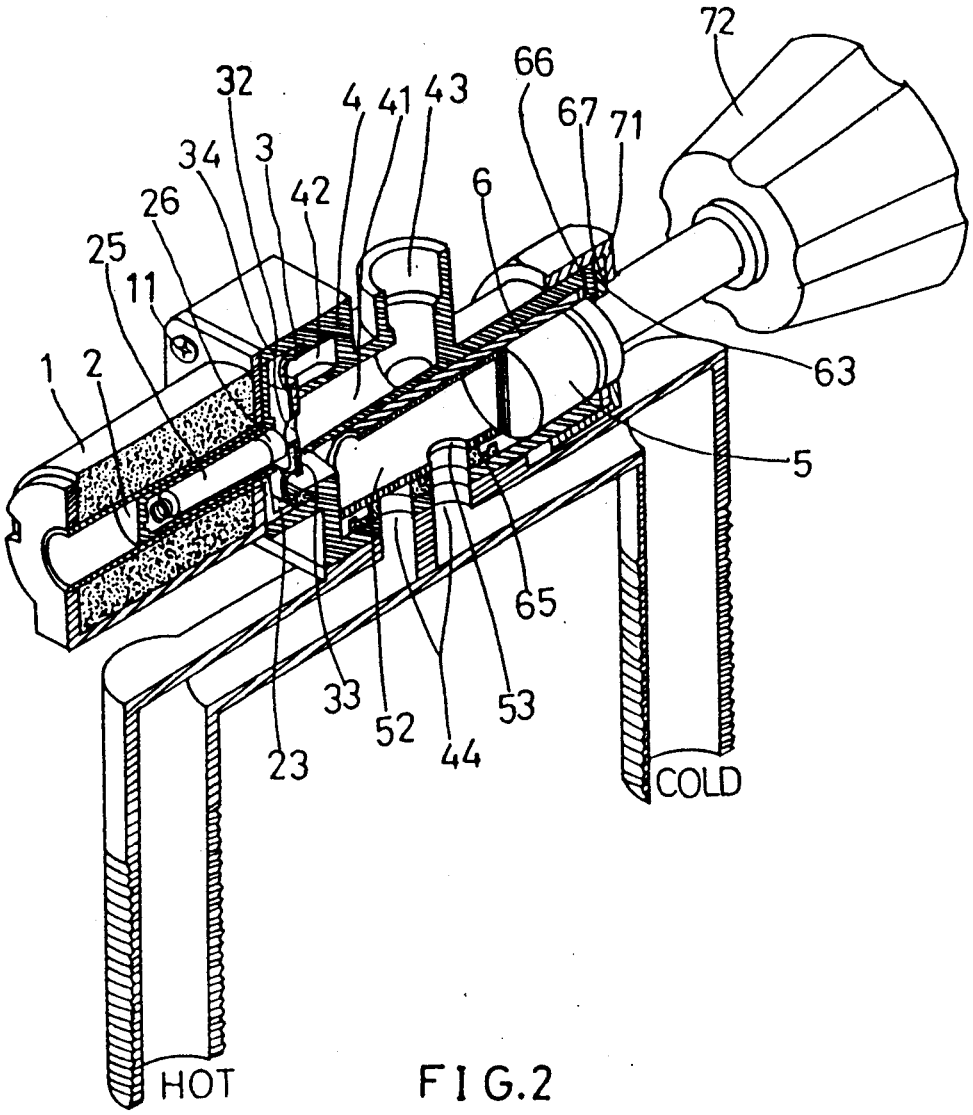
FIG. 2 is a perspective view of the subject invention.

Referring to FIGS. 1 and 2, the solenoid 1 produces or eliminates magnetic force lines with the switching off or on of the power source, to attract or release piston rod 25, which produces imbalance or balance of pressure in the balance pressure chamber 23, and which achieves water output or stoppage via the control valve seat 4.

Piston rod fixing seat 2 is a combination disc having sound-muffling groove 21 and piston rod sliding groove 22. The piston rod sliding groove 22 is to facilitate the sliding of piston rod 25 without deviation in its fixed position. Sound-muffling groove 21 is designed to eliminate the noise of pressure produced from the sliding of piston rod 25, to guide the turbulence in the piston rod sliding groove 22, so the turbulence can be guided by the sound-muffling groove and then smoothly discharged or drawn into the piston rod sliding groove 22. This enables smoother sliding of the piston rod 25, and reduces the noise to a minimum, thus preventing the user from having a fear of the automatic faucet due to its noise.

The piston rod fixing seat 2 and pressure release water stopping plate 3 produce a balanced pressure chamber 23 between them. The effect of the balanced pressure chamber 23 is, by means of the piston rod compression spring 24 pressing tightly against the piston rod 25, to press the soft piston rod water stopping nut sleeve 26 tightly against the pressure vent 32 on the metal fixing plate 31 in the water stopping plate 3. By means of the constant pressure hole 33 on the water stopping plate 3, the pressure is balanced between the water input guide groove 42 and the balance pressure chamber 23. This enables the soft constant pressure water stopper 3 to press tightly against the water output valve hole 41 to stop the water flow. (Refer to FIG. 3A.) When the solenoid 1 passes the current to produce magnetic forces, the piston rod 25 is drawn by the force, which causes the piston rod water stopping nut 26 to separate from the pressure vent hole 23. The pressure in the water guide groove 42 enters the balance pressure chamber 23 through the constant pressure hole 23. Because the constant pressure hole is smaller than the pressure vent hole 32, it results in outflow of water in the balance pressure chamber 23 at the pressure vent hole 32. The pressure buffer arc 34 on the constant pressure water stopping plate 3 is pressed by the pressure in the water inlet guide groove 42 and deformed. The constant pressure water stopping plate 3 is separated from the water output valve hole 41 to produce the discharge of water. (Please refer to FIG. 2.)

The water output tube fixing seat 43 is for the purpose of connection with required water output means. (Please refer to FIG. 2.)

The cold/hot water inlet 44 is the tube for entrance of cold/hot water into water output control valve seat 4.

The power cord or water stop pulling rod guide vent 45 is for the power cord for the light sensing switch 74, which controls the pulling lever to switch on or off the water stopper. The power cord passes through this guide vent to avoid rubbing by the mechanism, so that the power cord will not be damaged, or the pulling lever's movement will not be hindered.

The water inlet guide tube connector seat 46 is for connection to required water inlet tubes without the need for changing the mechanism of the water output control valve seat 4. (Please refer to FIG. 1.)

The water temperature regulating and water stopping functions are combined through the temperature regulating and water stopping turning shaft 5, and temperature regulating and water stopping turning shaft fixing seat 6. The temperature regulating and water stop turning shaft fixing seat 6 is made of special material to resist high heat and wear, to adapt to heat expansion of the temperature regulating and water stop turning shaft 5, to prevent the temperature regulating function from being jammed, and to ensure normal performance and free operation. To enable the temperature regulating and water stop turning shaft fixing seat 6 to have correct positioning above the water output control valve seat 4, there is the special design of the temperature regulating and water stop turning shaft fixing seat key 63, which facilitates repair, maintenance, and assembly. To prevent water outflow, an outflow check pacing ring 62 is used to restrict it. To enable entrance of hot or cold water into water output control valve seat 4, there is the design of the hot/cold water temperature regulating water inlet hole 64. The water inlet hole outflow stop water pad 65 restricts the water inlet tube and serves as the outflow check for temperature regulating and the water stop turning shaft 5. To enable sufficient water supply for water output, there is the design of an opening of fixed water output 61. To prevent malfunction of the temperature regulating and water stop turning shaft 5, there is the design of a special temperature regulating and water stop turning shaft fixing key 66 to restrict it. (Please refer to FIG. 5B).

The temperature regulating and water stop turning shaft is designed with a single handle to facilitate control, the water inlet overflow check packing ring is also the water inlet hole overflow check pad 65. An overflow check packing ring 54 is used between it and the temperature regulating and water stop turning shaft fixing seat 6, to avoid overflow. To mix hot and cold water, the hot/cold water mixing chamber 52 is designed to avoid inconsistent water temperature. To enable sufficient water output, a special water output opening 51 is designed with a dented opening. To enable the normal function of temperature regulation and water stoppage, a water inlet temperature regulating hole 53 is designed with infinite control to suit the user's required temperature. (Please refer to FIG. 2.) To fix the temperature regulating handle 72 in place, a temperature regulating handle fixing screw hole 56 is designed at the end of the temperature regulating and water stop turning shaft 5, to facilitate the positioning. To prevent improper turning of temperature regulating and water stop turning shaft 5, a special temperature regulating and water stop turning shaft fixing key 55 is designed to restrict it. (Please refer to FIG. 5A.)

To secure the temperature regulating and water stop function mechanism, the fixing nut 71 is used to tighten it. To prevent the occurrence of high water pressure and to securely fix the temperature regulating and water stop function mechanism, a metal pad 67 is fitted between the temperature regulating and water stop turning shaft fixing seat 6 and the fixing nut 71.

To prevent backflow of cold/hot water, a check valve is fitted at the water inlet tube which shall not be described in detail, since it is not a main point of the subject invention.

To conclude the above, in addition to the improvement of a conventional automatic sensing faucet which has no hot/cold water mixing device, the subject invention has taken careful consideration of the difficulty in assembly and the noise problems. In addition, this invention has considered the advantages of multiple purpose, light weight, and compact size, in order to save material and manual resources. Therefore, the practicability of the subject invention is itself a contribution.

I claim:

1. A photoelectric automatic sensing faucet, comprising:

a water inlet, a compact water temperature regulating and water stopping solenoid, a photoelectric sensing means for controlling said solenoid, a piston rod actuated by said solenoid, a piston rod fixing seat accommodating said piston rod, said piston rod fixing seat having a sound-muffling groove disposed at one end, a constant pressure water stop element, having a replaceable coated metal fixer plate, said fixer plate having a centrally disposed pressure release hole and a constant pressure hole disposed on a side, a water output control valve seat, a rotatable temperature regulating and water stop shaft having a water inlet temperature regulating hole, a hot/cold water mixing chamber, and a water outlet opening, a single handle controller attached to said temperature regulating and water stop shaft, a shaft positioning and fixing key for limiting movement of said shaft, a temperature regulating and water stop shaft fixing seat disposed circumferentially around said temperature regulating and water stop shaft, said seat arranged and constructed to adapt to changing temperature conditions, and a pliable water inlet hole overflow check pad, said check pad arranged and constructed to prevent overflow, and to facilitate adjustment of said temperature regulating and water stop shaft, whereby said temperature regulating and water stop shaft is displaceable automatically or manually, to control the temperature and flow of water.

2. A photoelectric automatic sensing faucet according to claim 1, further comprising a multi-purpose water inlet guide tube connector adapted for use in connection with a variety of inlet pipe arrangements.

* * * * *